US007140219B2

(12) United States Patent
Stecko

(10) Patent No.: US 7,140,219 B2
(45) Date of Patent: Nov. 28, 2006

(54) SWAGING HEAD ASSEMBLY

(75) Inventor: Ivan Stecko, Laval (CA)

(73) Assignee: MMC Automation Inc., Laval (CA)

( * ) Notice: Subject to any disclaimer, the term of this patent is extended or adjusted under 35 U.S.C. 154(b) by 0 days.

(21) Appl. No.: 11/043,125

(22) Filed: Jan. 27, 2005

(65) Prior Publication Data

US 2006/0162412 A1 Jul. 27, 2006

(51) Int. Cl.
*B21D 3/02* (2006.01)

(52) U.S. Cl. ..... 72/121; 72/104; 72/107

(58) Field of Classification Search ..... 72/102, 72/104, 107, 108, 110, 121, 123, 125
See application file for complete search history.

(56) References Cited

U.S. PATENT DOCUMENTS 2,294,685 A * 9/1942 Nelson ..... 72/104
4,426,869 A * 1/1984 Farmer et al. ..... 72/104
5,467,627 A * 11/1995 Smith et al. ..... 72/121
5,727,411 A * 3/1998 Sakakibara et al. ..... 72/110

* cited by examiner

*Primary Examiner*—Ed Tolan
(74) *Attorney, Agent, or Firm*—Ogilvy Renault LLP

(57) ABSTRACT

An apparatus for imparting a predetermined profile to one end of a workpiece mounted on a main axis. The apparatus comprises a rotary head mounted for rotation about the main axis and at least two fingers pivotally mounted to the rotary head for pivotal movement between an open position and a closed position. Each finger has a shaping tool adapted to engage the workpiece, and a cam mounted between said at least two fingers in riding contact with an inwardly facing cam surface thereof to pivot the fingers between said open and closed positions upon relative axial movement between the rotary head and the cam.

8 Claims, 1 Drawing Sheet

SWAGING HEAD ASSEMBLY

TECHNICAL FIELD

The invention relates generally to a swaging head assembly for performing a shaping or forming operation at one end portion of a workpiece.

BACKGROUND OF THE ART

Over the years various apparatuses have been developed for performing swaging operation on workpiece. Such swaging apparatuses generally comprises a rotary head carrying a number of forming rollers press in rolling contact with the workpiece to be profiled while the rotary head is driven in rotation.

Known swaging apparatuses are not well suited for high speed operations and include rather complex and cumbersome roller actuating mechanisms.

SUMMARY OF THE INVENTION

It is therefore an object of this invention to provide a new swaging head assembly which addresses the above mentioned problems.

In one aspect, the present invention provides a swaging head assembly for performing a shaping operation at one end of a workpiece mounted on a main axis, the swaging head assembly comprising: a rotary head member rotatable about the main axis, at least two pivotal fingers pivotally mounted at an intermediate location between opposed first and second ends thereof to the rotary head member, each pivotal finger carrying a shaping roller adapted to be engaged in rolling contact with the workpiece, and a cam mounted inwardly of said at least two fingers for pivoting the fingers between an open position and a closed position as a result of a relative axial displacement between the rotary head member and the cam.

In another aspect, the present invention provides an apparatus for imparting a predetermined profile to one end portion of a workpiece mounted on a main axis, the apparatus comprising a rotary head mounted for rotation about the main axis, at least two fingers pivotally mounted to the rotary head for pivotal movement between an open position and a closed position, each finger having a shaping tool adapted to engage the workpiece, and a cam mounted between said at least two fingers in riding contact with an inwardly facing cam surface thereof to pivot the fingers between said open and closed positions upon relative axial movement between the rotary head and the cam.

In another aspect, the present invention provides a swaging head assembly for producing an annular groove in one end portion of a workpiece mounted on a main axis, the apparatus comprising a rotary head mounted for rotation about the main axis, said rotary head being movable axially towards and away from the workpiece along said main axis, at least two fingers pivotally mounted to the rotary head, each finger having first and second opposed ends and an intermediate point of pivot therebetween, said first end having a cam surface on an inwardly facing side thereof, each finger carrying a groove forming roller at said second end thereof, said groove forming rollers being adapted to engage the workpiece when the fingers are closed against the one end portion of the workpiece, and a cam mounted internally of said rotary head between said first end of said at least two fingers for engagement with said cam surface thereof to pivot said fingers about said intermediate point of pivots between said open and closed positions upon relative axial movement between the rotary head and the cam.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figures 1A, 1B, 1C, 1D, 1E:
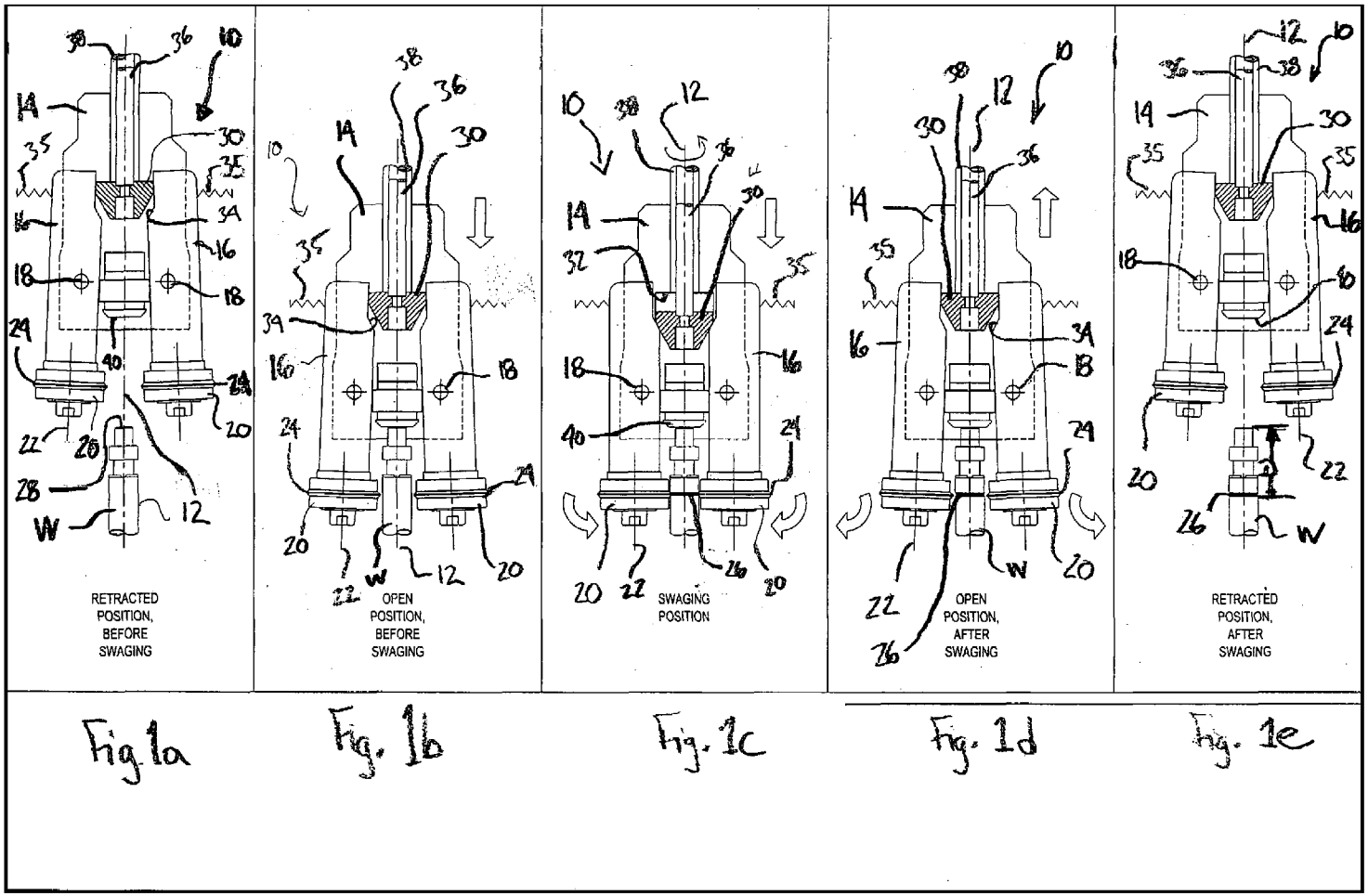
FIGS. 1*a*, 1*b*, 1*c*, 1*d* and 1*e* are schematic elevation views illustrating the sequence of the operations on a workpiece using a swaging head according to an embodiment of the present invention.

FIG. 1*a* illustrates a swaging head assembly 10 in a retracted position thereof before swaging a cylindrical workpiece W held thereunder in position by a fixture or any appropriate positioning system (not shown). The workpiece W (in the illustrated assembly a cylindrical lipstick container) is axially aligned with the central rotary axis 12 of the swaging head assembly 10. The swaging head assembly 10 is driven in rotation about axis 12 by a driving source (not shown), such as an electric motor.

The swaging head assembly 10 generally comprises a rotary head member 14 carrying a number of downwardly depending fingers 16 (three in the illustrated embodiment). The fingers 16 are uniformly distributed about the rotary head member 14 and are pivotally mounted thereto at 18. The pivots 18 are located at an intermediate location between the opposed longitudinal ends of the fingers 16.

Each finger 16 carries at a lower end thereof a shaping or forming tool, such as a roller 20 having a rotary axis 22 collinear with the longitudinal axis of the associated finger 16. The rollers 20 are preferably mounted for free rotation on needle bearings (not shown). A circumferential ridge 24 is provided on the outer surface of each roller 20 to form a circumferential groove 26 (FIGS. 1*c*, 1*d* and 1*e*) in the outer surface of the workpiece W at a predetermined distance D (FIG. 1*e*) from the upper end thereof 28. It is understood that the outer surface of the rollers 20 can have various shapes and configurations depending on the desired profile to be given to the upper end of the workpiece W.

The fingers 16 are pivoted between an open position (FIGS. 1*a*, 1*b*, 1*d* and 1*e*) and a closed position (FIG. 1*c*) by a cam 30. It has been found that mounting the cam 30 internally of the rotary head member 14 between the pivotal fingers 16 as opposed to externally with respect thereto greatly simplifies the overall assembly of the swaging head assembly 10. The cam 30 is received in a central seat 32 (FIG. 1*c*) defined in the bottom surface of the head member 14. The cam 30 has a generally frustoconical shape and is in sliding contact with a corresponding cam surface 34 provided on an inner side of the upper end of the fingers 16. The cam surface 34 has a tapered portion converging towards the axis 12 in a direction towards the workpiece W. The distance between the cam surface 34 and the point of pivot 18 of the fingers 16 provides a mechanical leverage allowing the rollers 20 to be closed against the workpiece with sufficient force to impart the desired profile to the workpiece W with little effort imparted onto the actuating end (i.e. the end with the cam surface 34) of the fingers 16. The configuration of the fingers 16 with the actuating portion at one end, the tool shaping portion at the other end and the intermediate point of pivot therebetween is thus advantageous.

Springs 35 are provided outwardly of the fingers 16 at the upper actuating end thereof to normally bias the fingers 16 to an open position as shown in FIGS. 1*a*, 1*b*, 1*d* and 1*e*.

The cam 30 is mounted at the distal end of a reciprocating shaft 36 coaxial with axis 12. The shaft 36 is actuated by any appropriate actuator (not shown), such as a pneumatic or hydraulic cylinder or a screw motor. The actuator (not shown) is operational to axially displace the cam 30 relatively to the rotary head member 14 and, thus, the fingers 16. According to another embodiment of the present invention, the cam 30 could be axially stationary while the rotary head 14 is axially displaced to create the required relative axial movement between the cam 30 and the fingers 16 to thereby allow the fingers 16 to open and closed under the action of the cam 30. According to this embodiment however the orientation of the cam 30 and the cam surface 34 would be turned upside down (i.e. the cam 30 would taper in an upward direction and the cam surface 34 would converge towards the axis 12 in an upward direction away from the workpiece W).

The reciprocating shaft 36 is coaxially received for axial movement in a hollow driving shaft 38 operated by a linear actuator (not shown) for lowering and raising the rotary head member 14.

A localization or positioning aid such as in the form of an abutting surface 40 is provided on the rotary head member 14 centrally between the fingers 16 at a predetermined distance from the shaping ridge 24 of the rollers 20; this predetermined distance corresponding to the desired distance D (FIG. 1*e*) between the end 28 of the workpiece W and the groove 26 to be formed. As shown in FIGS. 1*b* and 1*c*, the abutting surface 40 is shaped and configured to uniformly abut against the upper end 28 of the workpiece W to ensure that groove 26 be repeatedly and consistently formed at the same distance from the end 28 of each workpiece W being processed. The fixture (not shown) holding the workpiece W is preferably axially spring loaded to compensate for differences in length and height positioning between the different workpiece to be processed.

In operation, the rotary head member 14 is lowered over the workpiece W to be grooved until the abutting surface 40 abuts against the top end 28 of the workpiece, as shown in FIG. 1*b*. During this lowering phase, the cam 30 is retracted and the fingers 16 are urged to their open position by the springs 35. Once the rotary head member 14 has been appropriately position relative to the workpiece W, the cam 30 is displaced axially downwardly to cause the fingers to pivot to a closed position against the biasing force of the springs 35. As shown in FIG. 1*c*, in their closed position, the rollers 20 are firmly pressed against the outer surface of the workpiece W. The swaging head assembly 10 is then driven in rotation about axis 12 to cause the rollers 20 to roll over the workpiece W and thereby formed the circumferential groove 26. Once the grooving operation is completed, the cam 30 is retracted to allow the arm to pivot back to their open position under the biasing action of the springs 35, as shown in FIG. 1*d*. Finally, the rotary head member 14 is raised away from the workpiece W back to its retracted position, as shown in FIG. 1*e*. Then, a new workpiece W is mounted on the axis 12 underneath the swaging head assembly 10 and the above-described process is repeated all over again.

The above description is meant to be exemplary only, and one skilled in the art will recognize that changes may be made to the embodiments described without department from the scope of the invention disclosed. For example, it is understood that the above described vertical orientation of the apparatus is exemplary only and that the apparatus could be oriented otherwise. It is also understood that the workpiece W could be axially displaced between the fingers 16 in abutment against the abutting surface 40 while the rotary head member 14 remains in a fixed axial position. Still other modifications which fall within the scope of the present invention will be apparent to those skilled in the art, in light of a review of this disclosure, and such modifications are intended to fall within the appended claims.

The invention claimed is:

1. A swaging head assembly for performing a shaping operation at one end of a workpiece mounted on a main axis, the swaging head assembly comprising: a hollow driving shaft rotatable about the main axis, a rotary head member mounted to the hollow driving shaft, at least two pivotal fingers pivotally mounted at an intermediate location between opposed first and second ends thereof to the rotary head member, each pivotal finger carrying a shaping roller adapted to be engaged in rolling contact with the workpiece, a linearly reciprocable shaft concentrically received in the hollow driving shaft, and a cam mounted to said linearly reciprocable shaft inwardly of said at least two fingers for pivoting the fingers between an open position and a closed position as a result of a relative axial displacement between the rotary head member and the cam.

2. The swaging head assembly as defined in claim 1, wherein said rotary head member is linearly displaceable by said hollow driving shaft.

3. The swaging head assembly as defined in claim 1, wherein said shaping rollers are carried at said first end of said at least two fingers, and wherein said second end of said fingers defines an inwardly facing cam surface for engagement with the cam, and wherein the point of pivot of each of said at least two fingers is axially spaced from said cam surface.

4. The swaging head assembly as defined in claim 1, wherein said rotary head member has a localization aid adapted to abut an end surface of the workpiece to axially locate the shaping rollers at a predetermined distance from the end surface of the workpiece.

5. A swaging head assembly as defined in claim 1, wherein spring means is mounted outwardly of the fingers to normally bias the fingers to the open position thereof.

6. An apparatus for imparting a predetermined profile to one end portion of a workpiece mounted on a main axis, the apparatus comprising a rotary head mounted to a hollow driving shaft for rotation about the main axis, at least two fingers pivotally mounted to the rotary head for pivotal movement between an open position and a closed position, each finger having a shaping tool adapted to engage the workpiece, a linearly reciprocable shaft concentrically received in the hollow driving shaft, and a cam mounted to the linearly reciprocable shaft between said at least two fingers in riding contact with an inwardly facing cam surface thereof to pivot the fingers between said open and closed positions upon relative axial movement between the rotary head and the cam.

7. An apparatus as defined in claim 6, wherein said shaping tools are carried at a first end of said at least two fingers, and wherein each of said fingers is provided at a second end thereof opposite said first end with an inwardly facing cam surface for engagement with the cam.

8. A swaging head assembly for producing an annular groove in one end portion of a workpiece mounted to a hollow driving shaft on a main axis, the apparatus comprising a rotary head mounted for rotation about the main axis, said rotary head being movable axially towards and away from the workpiece along said main axis, at least two fingers pivotally mounted to the rotary head, each finger having first and second opposed ends and an intermediate point of pivot therebetween, said first end having a cam surface on an inwardly facing side thereof, each finger carrying a groove forming roller at said second end thereof, said groove forming rollers being adapted to engage the workpiece when the fingers are closed against the one end portion of the workpiece, and a cam mounted internally of said rotary head between said first end of said at least two fingers for engagement with said cam surface thereof to pivot said fingers about said intermediate point of pivots between said open and closed positions upon relative axial movement between the rotary head and the cam, wherein the cam is mounted internally of said rotary head at one end of a linearly reciprocable shaft, said linearly reciprocable shaft being concentrically received in the hollow driving shaft of said rotary head member.

* * * * *